US010364818B2

(12) United States Patent
Murayama

(10) Patent No.: US 10,364,818 B2
(45) Date of Patent: Jul. 30, 2019

(54) CENTRIFUGAL COMPRESSOR AND TURBOCHARGER

(71) Applicant: IHI Corporation, Koto-ku (JP)

(72) Inventor: Tomokazu Murayama, Tokyo (JP)

(73) Assignee: IHI Corporation, Koto-ku (JP)

( * ) Notice: Subject to any disclaimer, the term of this patent is extended or adjusted under 35 U.S.C. 154(b) by 459 days.

(21) Appl. No.: 14/982,643

(22) Filed: Dec. 29, 2015

(65) Prior Publication Data

US 2016/0131148 A1 May 12, 2016

Related U.S. Application Data

(63) Continuation of application No. PCT/JP2014/074804, filed on Sep. 19, 2014.

(30) Foreign Application Priority Data

Sep. 27, 2013 (JP) ..... 2013-201054

(51) Int. Cl.
*F04D 17/10* (2006.01)
*F04D 25/02* (2006.01)
(Continued)

(52) U.S. Cl.
CPC ..... *F04D 27/009* (2013.01); *F04D 17/10* (2013.01); *F04D 25/024* (2013.01);
(Continued)

(58) Field of Classification Search
CPC ..... F04D 27/009; F04D 27/0207; F04D 27/0238; F04D 29/4213; F04D 29/441; F05D 2250/21
See application file for complete search history.

(56) References Cited

U.S. PATENT DOCUMENTS 2,470,565 A * 5/1949 Loss ..... F04D 27/0207 415/11
6,623,239 B2 * 9/2003 Sahay ..... F02B 37/16 415/11
(Continued)

FOREIGN PATENT DOCUMENTS

CN 201908717 U 7/2011
CN 102221016 A 10/2011
(Continued)

OTHER PUBLICATIONS

Machine translation of JP 2008309029 A (Dec. 25, 2008).*
(Continued)

*Primary Examiner* — Igor Kershteyn
*Assistant Examiner* — Christopher R Legendre
(74) *Attorney, Agent, or Firm* — Oblon, McClelland, Maier & Neustadt, L.L.P.

(57) ABSTRACT

A centrifugal compressor includes a housing that accommodates a wheel. The housing includes an air intake space formed on an entrance side of the wheel; a flow passage to guide fluid compressed by the wheel to the outside of the housing; a return flow passage opened on each wall surface of the air intake space and the flow passage to circulate a part of the fluid in the flow passage to the air intake space without passing through the wheel; and an introduction portion provided in the air intake space, and having an inner peripheral surface that forms a flow passage to guide the fluid from the outside of the housing to the wheel. A downstream end of the inner peripheral surface in a flowing direction of the fluid is located radially inward of the wall surface of the housing.

7 Claims, 3 Drawing Sheets

(51) Int. Cl.

| | |
|---|---|
| ***F04D 27/00*** | (2006.01) |
| ***F04D 29/28*** | (2006.01) |
| ***F04D 29/42*** | (2006.01) |
| ***F04D 29/44*** | (2006.01) |
| ***F04D 29/46*** | (2006.01) |
| ***F04D 29/66*** | (2006.01) |
| ***F04D 27/02*** | (2006.01) |

(52) U.S. Cl.
CPC ..... *F04D 27/0238* (2013.01); *F04D 29/284* (2013.01); *F04D 29/4213* (2013.01); *F04D 29/4233* (2013.01); *F04D 29/441* (2013.01); *F04D 29/663* (2013.01); *F05D 2220/40* (2013.01); *F05D 2250/51* (2013.01); *F05D 2260/606* (2013.01); *F05D 2260/96* (2013.01)

(56) References Cited

U.S. PATENT DOCUMENTS

| | | | | |
|---|---|---|---|---|
| 8,021,104 | B2 * | 9/2011 | Gu | F04D 29/4213 415/56.5 |
| 8,287,232 | B2 * | 10/2012 | Gu | F04D 27/0215 415/56.5 |
| 8,517,664 | B2 * | 8/2013 | Sun | F02B 47/08 415/126 |
| 8,696,299 | B2 * | 4/2014 | Bywater | F02B 37/16 415/1 |
| 9,003,791 | B2 * | 4/2015 | Ibaraki | F01M 13/021 123/568.17 |
| 9,518,591 | B2 * | 12/2016 | Schmitt | F02B 39/00 |
| 2002/0071765 | A1 | 6/2002 | Sahay et al. | |
| 2008/0267765 | A1 | 10/2008 | Chen | |
| 2011/0011085 | A1 | 1/2011 | Garrett et al. | |
| 2011/0214421 | A1 * | 9/2011 | Schmitt | F02B 39/00 60/605.2 |
| 2011/0255952 | A1 | 10/2011 | Williams et al. | |
| 2012/0213627 | A1 | 8/2012 | Carter et al. | |
| 2013/0266436 | A1 * | 10/2013 | Ibaraki | F01M 13/021 415/208.1 |
| 2016/0131148 | A1 * | 5/2016 | Murayama | F04D 25/024 415/58.4 |

FOREIGN PATENT DOCUMENTS

| | | | |
|---|---|---|---|
| DE | 42 13 047 | A1 | 10/1993 |
| DE | 102 23 876 | A1 | 12/2003 |
| DE | 10 2008 014 681 | A1 | 10/2009 |
| EP | 2 615 308 | A1 | 7/2013 |
| GB | 2 256 460 | A | 12/1992 |
| JP | 5-113199 | A | 5/1993 |
| JP | 7-279677 | | 10/1995 |
| JP | 9-133098 | | 5/1997 |
| JP | 9-310699 | A | 12/1997 |
| JP | 11-173153 | | 6/1999 |
| JP | 2007-127108 | A | 5/2007 |
| JP | 2007-127109 | | 5/2007 |
| JP | 2008-309029 | | 12/2008 |
| JP | 4321037 | B2 | 8/2009 |
| JP | 2009-236035 | A | 10/2009 |
| JP | 2010-174806 | | 8/2010 |
| JP | 2012-184751 | | 9/2012 |
| JP | 2003-74360 | A | 3/2013 |
| JP | 2013-60878 | | 4/2013 |
| JP | 2013-224584 | | 10/2013 |
| JP | 5369723 | B2 | 12/2013 |
| JP | 5857421 | B2 | 2/2016 |
| WO | WO 2011/099419 | A1 | 8/2011 |

OTHER PUBLICATIONS

Combined Chinese Office Action and Search Report dated Apr. 25, 2017 in Patent Application No. 201480039501.9 (with English translation of Categories of Cited Documents).

Extended European Search Report dated May 16, 2017 in Patent Application No. 14847943.9.

International Search Report dated Nov. 25, 2014 in PCT/JP2014/074804 filed Sep. 19, 2014 (with English translation).

Written Opinion dated Nov. 25, 2014 in PCT/JP2014/074804 filed Sep. 19, 2014.

Combined Chinese Office Action and Search Report dated Dec. 2, 2016 in Patent Application No. 201480039501.9 (with English translation of Categories of Cited Documents).

* cited by examiner

CENTRIFUGAL COMPRESSOR AND TURBOCHARGER

CROSS REFERENCE TO RELATED APPLICATIONS

This application is a continuation application of International Application No. PCT/JP2014/074804, filed on Sep. 19, 2014, which claims priority to Japanese Patent Application No. 2013-201054, filed on Sep. 27, 2013, the entire contents of which are incorporated by reference herein.

BACKGROUND

1. Technical Field

The present disclosure relates to a centrifugal compressor and a turbocharger, in which formed is a return flow passage for circulating part of compressed air to the upstream side.

2. Description of the Related Art

A conventional turbocharger includes a bearing housing, a shaft that is rotatably held by the bearing housing, a turbine wheel provided at one end of the shaft, and a compressor wheel provided at the other end of the shaft. Such a turbocharger is connected with an engine. The exhaust gas discharged from the engine rotates the turbine wheel. With the rotation of the turbine wheel, the compressor wheel rotates through the shaft.

In the turbocharger described above, air is compressed along with rotation of the compressor wheel, and is delivered to the engine. Meanwhile, for example, in the case of a vehicle that mounts the turbocharger, if the throttling valve for the engine is closed as a result, for example, of turning off of the accelerator, supercharging pressure rises whereas the flow rate of air decreases. This leads to a large change in pressure or the flow rate of fluid, which may cause noises (so-called surges). Thus, as described, for example, in Japanese Patent Laid-Open Publication No. 07-279677, it is common practice to employ a configuration in which a return flow passage that communicates upstream and downstream sides of the compressor wheel is separately provided in the compressor housing having the compressor wheel accommodated therein, and the return flow passage is opened or closed by an air bypass valve. With this configuration, the air bypass valve is opened when the supercharging pressure rises, and part of the compressed air is circulated to the upstream side of the compressor wheel, so that surges can be suppressed. Such a return flow passage can be applied not only to turbochargers but also to any centrifugal compressors.

SUMMARY

In the centrifugal compressor provided with the return flow passage as described above, air passes through the return flow passage and is circulated from the downstream of the compressor wheel to the upstream. Then, this air merges with the main flow of air on the upstream of the compressor wheel. Thus, the circulated air interferes with the main flow, which possibly disturbs the main flow. Depending on operational conditions, this disturbance of the main flow may cause a large noise in association with the flow of air, which possibly leads to deterioration in quietness.

An object of the present disclosure is to provide a centrifugal compressor and a turbocharger that can improve quietness while suppressing surges.

A first aspect of the present disclosure is a centrifugal compressor, including: a compressor wheel fixed to an end portion of a rotating shaft; a compressor housing configured to accommodate the compressor wheel; an air intake space formed in the compressor housing, provided extending on an extension line of the rotating shaft, and located on a front side of the compressor wheel; a downstream-side flow passage provided on an outside in a radial direction of the rotating shaft with respect to the compressor wheel, configured to guide fluid sucked from the air intake space and compressed by the compressor wheel, to the outside of the compressor housing; a return flow passage provided with one end and the other end, the one end opened to a wall surface of the compressor housing that forms the downstream-side flow passage, and the other end opened to a wall surface of the compressor housing that forms the air intake space, the return flow passage configured to circulate the fluid guided by the downstream-side flow passage, from the downstream-side flow passage to the air intake space; and an introduction portion provided in the air intake space, including an inner peripheral surface forming a flow passage to guide fluid from the outside of the compressor housing into the air intake space, a downstream end of the inner peripheral surface in a flowing direction of the fluid being located inside in the radial direction of the rotating shaft than the wall surface of the compressor housing on which the other end of the return flow passage is opened.

The introduction portion may include a diameter-reducing portion, and the diameter-reducing portion has an inner diameter reducing from an upstream side of the diameter-reducing portion toward a downstream side thereof in the flowing direction of the fluid.

A ring-shaped passage circularly extending in a rotational direction of the rotating shaft may be provided outside in the radial direction of the rotating shaft than the introduction portion, and inside in the radial direction of the rotating shaft than an opening of the return flow passage on a side of the air intake space.

The ring-shaped passage may extend toward an upstream end side of the introduction portion than the opening of the return flow passage on the side of the air intake space, and a cross-sectional area of the ring-shaped passage in the radial direction of the rotating shaft may increase from the upstream end side of the introduction portion toward a downstream end side thereof.

At least a part of the opening of the return flow passage on the side of the air intake space may overlap with the introduction portion in the radial direction of the rotating shaft.

The introduction portion may be detachably provided into the compressor housing

A partition wall that circularly extends in the rotational direction of the rotating shaft may be disposed on the compressor wheel side than the downstream end of the introduction portion in the air intake space, and a circulation flow passage may be formed between an outer peripheral surface of the partition wall and the wall surface of the compressor housing that forms the air intake space, the circulation flow passage is configured to guide the fluid from the compressor wheel side toward the introduction portion side.

A second aspect of the present disclosure is a turbocharger including a centrifugal compressor according to the first aspect.

According to the present disclosure, it is possible to improve quietness while suppressing surges by providing a return flow passage.

DESCRIPTION OF THE EMBODIMENTS

Hereinbelow, an embodiment of the present disclosure will be described in detail with reference to the attached drawings. Dimensions, materials, specific numbers, and other items described in the embodiment are merely examples for facilitating understanding of the invention. Thus, these pieces of information do not restrict the present invention. Note that, in this specification and the drawings, the same reference signs are attached to elements having substantially the same function or configuration, and explanation thereof will not be repeated. Furthermore, elements that are irrelevant to the present disclosure are not illustrated.

In the following embodiment, description will be made of a turbocharger including a centrifugal compressor as an example. Schematic configuration of the turbocharger will be first described, and then, details of the configuration of the centrifugal compressor of the turbocharger will be described.

Figure 1:
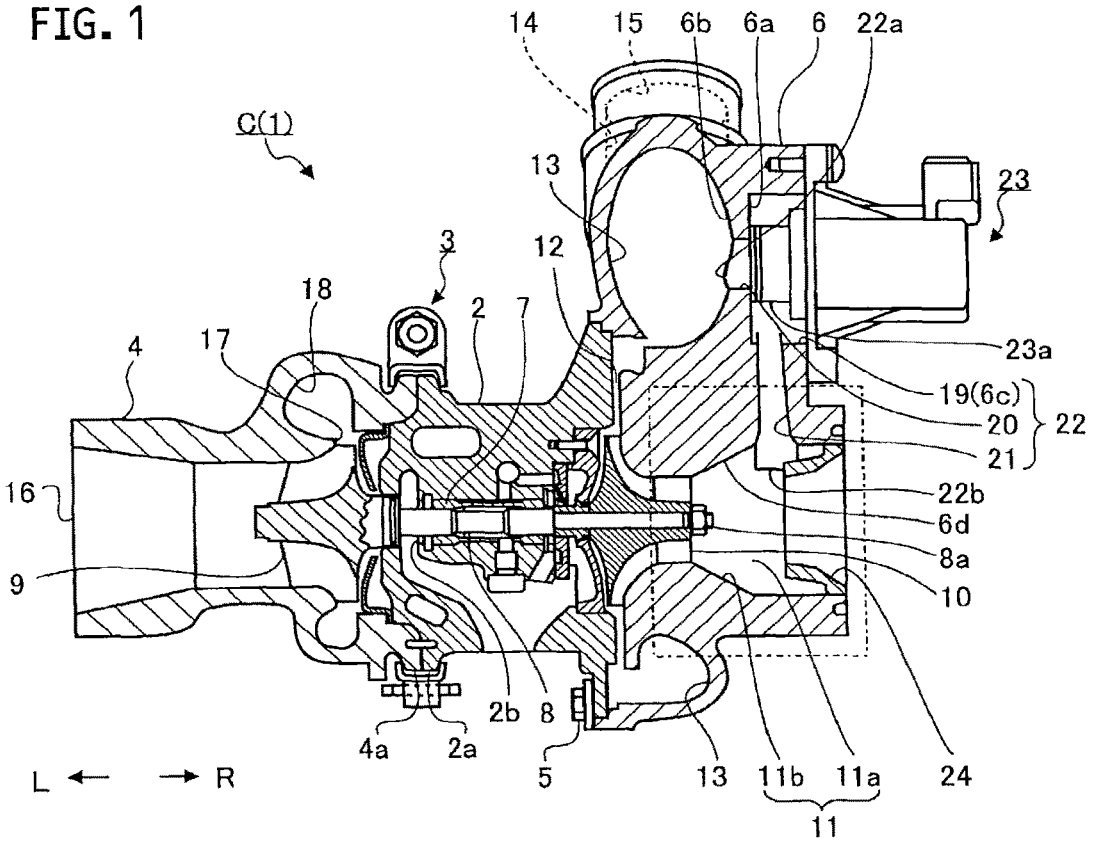
FIG. 1 is a sectional view schematically illustrating a turbocharger according to an embodiment of the present disclosure.

FIG. 1 is a sectional view schematically illustrating a turbocharger C. Below, the arrow L illustrated in FIG. 1 indicates the left direction of the turbocharger C, and the arrow R indicates the right direction of the turbocharger C. As illustrated in FIG. 1, the turbocharger C includes a turbocharger body 1. The turbocharger body 1 includes a bearing housing 2, a turbine housing 4 that is connected to the left side of the bearing housing 2 with a fastening mechanism 3, and a compressor housing 6 that is connected to the right side of the bearing housing 2 with a fastening bolt 5. These portions are integrated.

A protrusion 2*a* is provided on the outer peripheral surface of the bearing housing 2 and in the vicinity of the turbine housing 4. The protrusion 2*a* protrudes radially outward from the bearing housing 2. Furthermore, a protrusion 4*a* is provided on the outer peripheral surface of the turbine housing 4 and in the vicinity of the bearing housing 2. The protrusion 4*a* protrudes radially outward from the turbine housing 4. The bearing housing 2 and the turbine housing 4 are fixed with each other in a manner such that the protrusions 2*a* and 4*a* are fastened with the fastening mechanism 3. The fastening mechanism 3 is configured with a fastening band (G coupling) that clamps the protrusions 2*a* and 4*a*.

The bearing housing 2 has a bearing hole 2*b* formed therein so as to penetrate in the left-right direction of the turbocharger C. The bearing hole 2*b* accommodates a bearing 7. The bearing 7 rotatably supports a shaft 8 (rotating shaft). The shaft 8 has one end integrally fixed with a turbine wheel 9. The turbine wheel 9 is rotatably accommodated in the turbine housing 4. The shaft 8 has the other end (end portion 8*a*) integrally fixed with a compressor wheel 10. The compressor wheel 10 is rotatably accommodated in the compressor housing 6.

The compressor housing 6 has an air intake space 11 formed therein. The air intake space 11 is opened to the right side of the turbocharger C, and is connected with an air cleaner, not illustrated. The air intake space 11 is provided extending on the extension line of the shaft 8 in the axial direction. Furthermore, the air intake space 11 is located on the front side of the compressor wheel 10. The air intake space 11 has an intake-air flow passage 11*a* formed therein. As the compressor wheel 10 rotates, fluid (for example, air) is sucked from the outside of the compressor housing 6 toward the front of the compressor wheel 10. The sucked fluid circulates within the intake-air flow passage 11*a*. Furthermore, the air intake space 11 has a tapered portion 11*b* formed therein. The tapered portion 11*b* has the inner diameter gradually decreased toward the compressor wheel 10. Here, with respect to the compressor wheel 10, the turbine wheel 9 side of the shaft 8 in the axial direction is the rear side, and the opposite side thereof is the front side.

In a state where the bearing housing 2 and the compressor housing 6 are connected with the fastening bolt 5, the surfaces of the housings 2 and 6 facing each other form a diffuser flow passage 12 that increases the pressure of the fluid. The diffuser flow passage 12 is formed in a ring shape, and extends from the inside in the radial direction of the shaft 8 toward the outside. Furthermore, the diffuser flow passage 12 communicates with the air intake space 11 through the compressor wheel 10 on the inside in the radial direction of the shaft 8.

The compressor housing 6 includes a compressor scroll flow passage (downstream-side flow passage) 13. The compressor scroll flow passage 13 is formed in a ring shape, and is located outside in the radial direction of the shaft 8 than the diffuser flow passage 12. The compressor scroll flow passage 13 communicates with an air intake of the engine, not illustrated, and also communicates with the diffuser flow passage 12. Thus, as the compressor wheel 10 rotates, fluid is sucked into the air intake space 11 from the outside of the compressor housing 6. Furthermore, pressures and speeds of the sucked fluid are increased, for example, due to an effect of the centrifugal force during a process in which the fluid circulates between blades of the compressor wheel 10, and then, pressures of the sucked fluid are increased through the diffuser flow passage 12 and the compressor scroll flow passage 13.

As described above, the fluid sucked from the air intake space 11 is compressed by the use of the rotation of the compressor wheel 10. The fluid, which has passed through the compressor wheel, circulates through the compressor scroll flow passage 13 and an exhaust flow passage 14 (downstream-side flow passage) by way of the diffuser flow passage 12, and passes through an exhaust port 15 to be guided to the outside of the compressor housing 6. Then, the air is discharged into an air intake of the engine connected to the exhaust port 15.

The turbine housing 4 has a discharge port 16 formed therein. The discharge port 16 is opened to the left side of the turbocharger C. The discharge port 16 is connected with an exhaust-gas cleaning device, not illustrated. Furthermore, the turbine housing 4 includes a flow passage 17 and a turbine scroll flow passage 18. The turbine scroll flow passage 18 is formed into a ring shape, and is located outside in the radial direction of the shaft 8 than the flow passage 17. The turbine scroll flow passage 18 communicates with a gas inlet port with which the exhaust gas discharged from the exhaust manifold, not illustrated, of the engine is guided. Furthermore, the turbine scroll flow passage 18 also communicates with the flow passage 17 described above. Thus, the exhaust gas from the engine is guided from the gas inlet port into the turbine scroll flow passage 18, and is guided to the discharge port 16 by way of the flow passage 17 and the turbine wheel 9. During this circulation process, the exhaust gas rotates the turbine wheel 9. Furthermore, the rotational force of the turbine wheel 9 described above is transmitted through the shaft 8 to the compressor wheel 10. With the rotational force of the compressor wheel 10, pressures of the fluid are increased as described above, and the fluid is guided into the air intake of the engine.

Incidentally, for example, in the case of a vehicle that mounts the turbocharger C, if the throttling valve for the engine is closed as a result, for example, of turning off of the accelerator, supercharging pressure rises whereas the flow rate decreases. This leads to an occurrence of surge, which may cause unnecessary noises. Thus, the compressor housing 6 is provided with a mechanism that causes part of the compressed fluid to circulate to the upstream side thereof.

This mechanism will be described in detail. As illustrated in FIG. 1, the compressor housing 6 of the turbocharger body 1 has a hole 19 formed from the right side thereof. The hole 19 has a bottom surface disposed on the wall surface 6*a* of the compressor housing 6. A through passage 20 is provided between the hole 19 (the bottom surface of the hole 19) and the compressor scroll flow passage 13. The through passage 20 penetrates from the wall surface 6*a* of the compressor housing 6 to a wall surface 6*b* of the compressor housing 6 that forms the compressor scroll flow passage 13.

Furthermore, a through passage 21 is formed between the hole 19 and the air intake space 11. The through passage 21 penetrates from a wall surface 6*c* of the compressor housing 6 disposed on the inner peripheral surface of the hole 19, to a wall surface 6*d* of the compressor housing 6 that forms the inner peripheral surface of the air intake space 11.

A return flow passage 22 is formed by the hole 19 and the through passages 20 and 21. The return flow passage 22 has one end 22*a* that is located at the wall surface 6*b* of the compressor housing 6 that forms the compressor scroll flow passage 13. The return flow passage 22 has the other end 22*b* that is located on the upstream side of the tapered portion 11*b* at the wall surface 6*d* of the compressor housing 6 that forms the air intake space 11. In other words, the return flow passage 22 is opened to each of the wall surface 6*b* and the wall surface 6*d*.

The return flow passage 22 circulates part of the compressed fluid guided by the compressor scroll flow passage 13, from the compressor scroll flow passage 13 to the air intake space 11.

An air bypass valve 23 is an electrically-operated valve that opens and closes the opening of the through passage 20 on the hole side, on the basis of, for example, measured values of supercharging pressures or control states of the engine. A valve body 23*a* of the air bypass valve 23 is disposed so as to be able to be brought into contact with a seat surface located in the vicinity of the through passage 20 and on the wall surface 6*a* of the compressor housing 6. The actuator of the air bypass valve 23 enables the valve body 23*a* to move, thereby closing the through passage 20 by bringing the valve body 23*a* into contact with the seat surface, or opening the through passage 20 by spacing the valve body 23*a* apart from the seat surface.

Here, description has been made of the case where the air bypass valve 23 is an electrically-operated valve. However, the air bypass valve 23 may be a mechanical valve that actuates a diaphragm with a pressure difference between the exhaust flow passage 14 and the air intake space 11, thereby opening or closing the opening.

In the case where the supercharging pressure rises and the flow rate excessively decreases, the air bypass valve 23 is opened to cause part of the compressed fluid to circulate it to the air intake space 11, which is located on the upstream side of the compressor wheel 10, to increase the flow rate of the fluid flowing toward the compressor wheel 10, so that surges can be suppressed.

Furthermore, a diameter-reducing portion 24 (introduction portion) composed of a ring-shaped member formed separately from the compressor housing 6 is provided in the air intake space 11.

Figure 2:
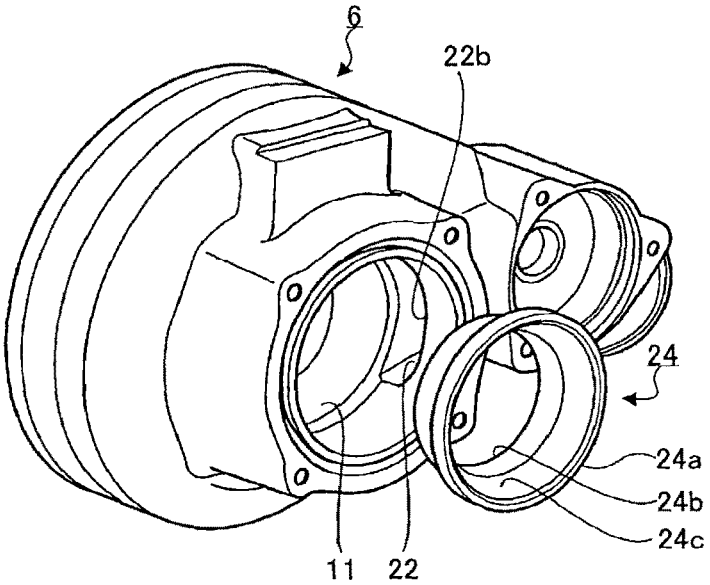
FIG. 2 is an exploded perspective view illustrating a compressor housing and a diameter-reducing portion according to an embodiment of the present disclosure.

FIG. 2 is an exploded perspective view illustrating the compressor housing 6 and the diameter-reducing portion 24. As illustrated in FIG. 2, the diameter-reducing portion 24 is formed into a tapered shape in which the inner diameter and the outer diameter gradually reduce from the upstream end 24*a* toward the downstream end 24*b*. More specifically, the diameter-reducing portion 24 serves as an introduction passage with which the fluid is guided from the outside of the compressor housing 6, and forms part of the intake-air flow passage 11*a* in which the fluid guided from the outside to the compressor housing 6 flows. The inner diameter and the outer diameter of the diameter-reducing portion 24 gradually reduce from the upstream side (upstream end 24*a* side) of the intake-air flow passage 11*a* in the fluid flowing direction toward the downstream side (downstream end 24*b* side).

The diameter-reducing portion 24 is press fitted into the air intake space 11, and is fixed to the compressor housing 6. At this time, the opening (other end 22*b*) of the return flow passage 22 on the air intake space 11 side is located on the downstream side in the fluid flowing direction of the intake-air flow passage 11*a* than the upstream end 24*a* of the diameter-reducing portion 24, and is located outside in the radial direction of the shaft 8 than an inner peripheral surface 24*c* at the downstream end 24*b*.

Furthermore, the downstream end 24*b* of the diameter-reducing portion 24 and the other end 22*b* of the return flow passage 22 have a positional relationship in which they partially overlap with each other in the radial direction of the shaft 8. Positional relationships between the compressor housing 6 and the diameter-reducing portion 24 will be described in more detail with reference to FIG. 3.

Figure 3:
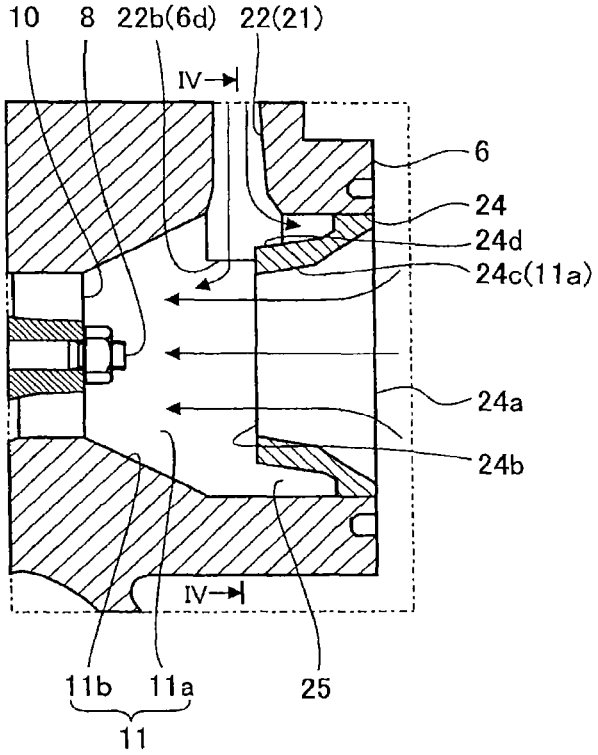
FIG. 3 is a diagram in which a portion surrounded by the dot-and-dash line in FIG. 1 is extracted.

FIG. 3 is a diagram in which a portion surrounded by the dot-and-dash line in FIG. 1 is extracted. Note that, in FIG. 3, the flow of the fluid is indicated by the arrows. As illustrated in FIG. 3, the other end 22*b* of the return flow passage 22 is located on the wall surface 6*d* that forms the air intake space 11. Furthermore, an outer peripheral surface 24*d* of the diameter-reducing portion 24, which is press fitted into the air intake space 11, is brought into contact with the compressor housing 6 on the upstream end 24*a* side. The outer peripheral surface 24*d* has a tapered shape in which the outer peripheral surface 24*d* protrudes inward in the radial direction of the shaft 8 toward the downstream end 24*b* side.

As described above, the other end 22*b* of the return flow passage 22 is located outside in the radial direction of the shaft 8 than the inner peripheral surface 24*c* at the downstream end 24*b* of the diameter-reducing portion 24, by the degree corresponding to the protrusion of the downstream end 24*b* of the diameter-reducing portion 24 from the wall surface 6*d* of the compressor housing 6 to the inside of the shaft 8 in the radial direction, and by the degree corresponding to the thickness of the diameter-reducing portion 24. In other words, the downstream end 24*b* of the inner peripheral surface of the diameter-reducing portion 24, which forms the flow passage to guide the fluid from the outside of the compressor housing 6, is located inside in the radial direction of the shaft 8 than the wall surface 6*d* of the compressor housing 6 on which the other end 22*b* of the return flow passage 22 is opened.

As a result, the direction of the fluid that flows out from the other end 22*b* of the return flow passage 22 is corrected (deflected) to the direction along the flow of the main flow of the fluid flowing from the diameter-reducing portion 24 toward the compressor wheel 10 before the fluid merges with the main flow. Thus, the fluid that is circulated through the return flow passage 22 is less likely to interfere with the main flow, whereby it is possible to suppress occurrence of noises, improving quietness. In addition, the main flow is less likely to be disturbed. Thus, detachment of the flow, which serves as a cause of surge, can be suppressed, whereby it is possible to extend the range of flow rate in which surges can be suppressed.

Furthermore, the ring-shaped passage 25 is formed between the outer peripheral surface 24*d* of the diameter-reducing portion 24 and the wall surface 6*d* of the compressor housing 6 that forms the air intake space 11. In other words, the ring-shaped passage 25 is formed outside in the radial direction of the shaft 8 than the outer peripheral surface 24*d* of the diameter-reducing portion 24, and inside in the radial direction of the shaft 8 than the other end 22*b* of the return flow passage 22. The ring-shaped passage 25 circularly extends in the rotational direction (in the circumferential direction) of the shaft 8.

Part of the fluid flowing out from the other end 22*b* of the return flow passage 22 first flows into the ring-shaped passage 25. Then, the fluid merges with the main flow while flowing along the outer peripheral surface 24*d* of the diameter-reducing portion 24 in the rotational direction of the shaft 8. The main flow forms a circulation flow that flows in the rotational direction and the axial direction of the shaft 8 due to the effect of the rotation of the compressor wheel 10. Thus, the fluid flowing out from the other end 22*b* of the return flow passage 22 merges with the main flow almost without disturbing the flow of the main flow.

Furthermore, the ring-shaped passage 25 extends toward closer to the upstream end 24*a* (upstream end) side of the diameter-reducing portion 24 than the other end 22*b* of the return flow passage 22. The cross-sectional area of the ring-shaped passage 25 in the radial direction of the shaft 8 increases from the upstream end 24*a* side of the diameter-reducing portion 24 toward the downstream end 24*b* side.

The fluid flowing out from the other end 22*b* of the return flow passage 22 and flowing into the ring-shaped passage 25 is more likely to flow toward the direction of a large cross-sectional area. In other words, this fluid easily flows toward the downstream side of the flow of the main flow. Thus, it is possible to further reduce the influence of disturbance of the main flow caused by the fluid merging with the flow of the main flow from the ring-shaped passage 25.

Furthermore, part of the other end 22*b* of the return flow passage 22 overlaps with the diameter-reducing portion 24 when viewed from the radial direction (up-down direction and a direction perpendicular to the axial direction in FIG. 3) of the shaft 8. In other words, the other end 22*b* of the return flow passage 22 is located on the outside in the radial direction of the shaft 8 with respect to the diameter-reducing portion 24. Here, part of the other end 22*b* of the return flow passage 22 overlaps with the downstream end 24*b* of the diameter-reducing portion 24 in the radial direction of the shaft 8. In other words, part of the other end 22*b* of the return flow passage 22 is located so as to overlap with the downstream end 24*b* of the diameter-reducing portion 24 in the axial direction of the shaft 8.

As a result, part of the fluid flowing out from the other end 22*b* of the return flow passage 22 hits against the outer peripheral surface 24*d* of the diameter-reducing portion 24, and the fluid velocity thereof reduces, which makes it easy for the fluid to flow through the ring-shaped passage 25 along the outer peripheral surface 24*d*. Thus, it is possible to further prevent disturbance of the main flow caused by the fluid flowing out from the other end 22*b* of the return flow passage 22.

As described above, the diameter-reducing portion 24 is a member provided separately from the compressor housing 6, and is detachably provided in the compressor housing 6. Thus, it is possible to easily perform processing in a manner such that the other end 22*b* of the return flow passage 22 is located outside in the radial direction of the shaft 8 than the inner peripheral surface 24*c* at the downstream end 24*b* of the diameter-reducing portion 24 as described above, as compared with the case where the diameter-reducing portion 24 is formed integrally with the compressor housing 6.

In addition, by configuring the diameter-reducing portion 24 as a member provided separately from the compressor housing 6 as described above, and forming the ring-shaped passage 25 as described above, it is possible to reduce the contact area of the diameter-reducing portion 24 and the compressor housing 6. This makes it possible to easily press fit the diameter-reducing portion 24.

Moreover, the through passage 21 that forms the return flow passage 22 is devised so as not to disturb the main flow. More specifically, first, the through passage 21 is formed in a manner such that the width of the flow passage in the axial direction of the shaft 8 increases toward the side of the wall surface 6*d* that forms the air intake space 11.

Figure 4A:
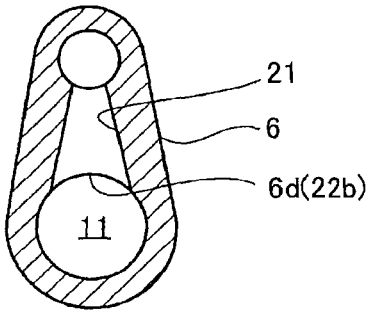
FIG. 4A is a diagram for explaining a through passage according to an embodiment of the present disclosure.
Figure 4B:
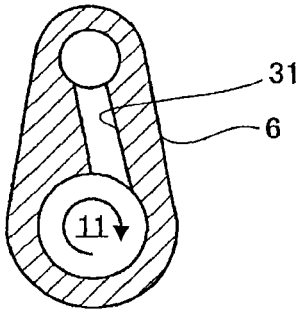
FIG. 4B is a diagram for explaining a first modification example of the through passage.

FIGS. 4A and 4B are explanatory views for explaining the through passage 21, and illustrate the shape of cross section taken along the IV-IV line in FIG. 3 in a simplified manner. In FIGS. 4A and 4B, the diameter-reducing portion 24 is not illustrated. As illustrated in FIG. 4A, the through passage 21 is formed in a manner such that the width of the flow passage in a planar direction (planar direction of the cross section take along IV-IV line) perpendicular to the axial direction of the shaft 8 is increased toward the side of the wall surface 6*d* that forms the air intake space 11.

As described above, the through passage 21 is formed in such a manner that the flow passage cross-sectional area perpendicular to the fluid flowing direction increases toward the side of the wall surface 6*d* that forms the air intake space 11. With this configuration, the fluid flowing through the through passage 21 flows at a reduced fluid velocity, and hence, is less likely to disturb the flow of the main flow.

Furthermore, it may be possible to employ a configuration in which a through passage 31 extends along the flowing direction of a circulation flow occurring in the main flow within the air intake space 11, so as to be sloped with respect to the radial direction of the shaft 8, as illustrated in FIG. 4B given as a first modification example. Even with such a configuration, the fluid flowing through the through passage 21 flows along the circulation flow and merges with the main flow, and hence, is less likely to disturb the flow of the main flow.

In addition, in this embodiment, description has been made of the case where the through passage 21 extends parallel to the radial direction of the shaft 8 as illustrated in FIG. 3. However, the through passage may extend so as to be closer to the compressor wheel 10 while the through passage extends from the hole 19 (see FIG. 1) toward the air intake space 11, and may be sloped to the axial direction of the shaft 8 along the flow in the axial direction of the shaft 8 in the main flow within the air intake space 11.

Figure 5:
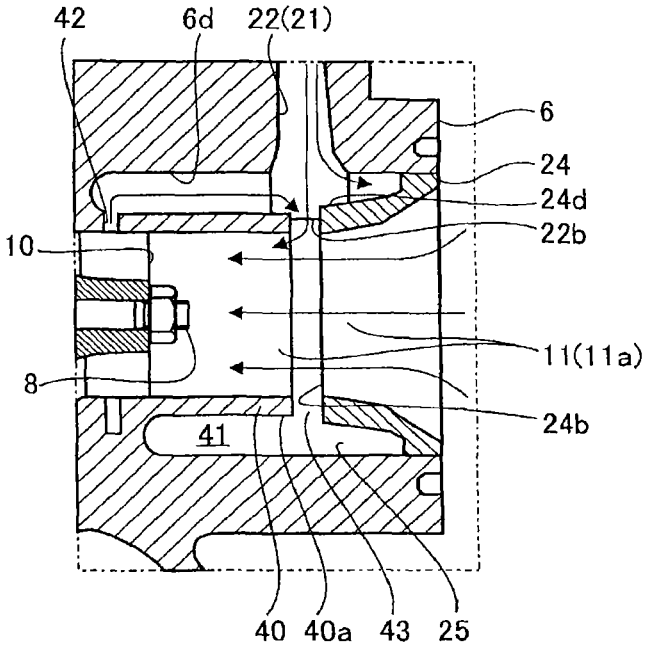
FIG. 5 is a diagram for explaining a second modification example of the through passage.

FIG. 5 is an explanatory view for explaining a second modification example. Note that, in FIG. 5, the arrows indicate the flow of the fluid. As illustrated in FIG. 5, in the second modification example, a partition wall 40 is formed in addition to the diameter-reducing portion 24.

The partition wall 40 is disposed on the compressor wheel 10 side than the downstream end 24*b* of the diameter-reducing portion 24 in the air intake space 11. Furthermore, the partition wall 40 circularly extends in the rotational direction of the shaft 8. A circulation flow passage 41 is formed between the outer peripheral surface 40*a* of the partition wall 40 and the wall surface 6*d* of the compressor housing 6 that forms the air intake space 11. The partition wall 40 functions as a boundary for separating the circulation flow passage 41 from the air intake space 11, and is formed integrally with the compressor housing 6.

With the ring-shaped communication passage 42 extending in the rotational direction of the shaft 8, the circulation flow passage 41 communicates with a portion of the air intake space 11 where the compressor wheel 10 is located. Thus, the fluid flowing from the communication passage 42 into the circulation flow passage 41 passes through the circulation flow passage 41, and is guided from the compressor wheel 10 side to the diameter-reducing portion 24 side, in other words, from the downstream side in the flowing direction of the main flow to the upstream side.

Then, the fluid circulates to the main flow (intake-air flow passage 11*a*) from a space 43 formed between the partition wall 40 and the diameter-reducing portion 24. As a result, the flow rate of the main flow flowing through the intake-air flow passage 11*a* increases, and hence, surges are suppressed.

Furthermore, part of the other end 22*b* of the return flow passage 22 overlaps with the downstream end 24*b* of the diameter-reducing portion 24 and the partition wall 40 in the radial direction of the shaft 8.

The fluid flowing out from the other end 22*b* of the return flow passage 22 merges with the fluid flowing through the circulation flow passage 41, and then, flows into the intake-air flow passage 11*a* from the space 43. At this time, part of the fluid flowing out from the other end 22*b* of the return flow passage 22 hits against the outer peripheral surface 40*a* of the partition wall 40, or the outer peripheral surface 24*d* of the diameter-reducing portion 24. This hitting leads to a reduction in the fluid velocity of the fluid, and also makes it easy for the fluid to flow through the ring-shaped passage 25 along the outer peripheral surface 40*a* of the partition wall 40, or the outer peripheral surface 24*d* of the diameter-reducing portion 24. Thus, it is possible to further suppress the disturbance of the main flow caused by the fluid flowing out from the other end 22*b* of the return flow passage 22.

In the embodiment and the modification examples described above, description has been made of the case where the introduction portion, which forms the flow passage guiding the fluid flowing in from the outside of the compressor housing 6, is configured by the diameter-reducing portion 24 having an inner diameter reducing from the upstream side thereof toward the downstream side thereof. However, the introduction portion may have a constant inner diameter, or may be formed in a manner such that a step is formed on the inner peripheral surface thereof, and the inner diameter of the introduction portion reduces in a discontinued manner from the upstream side toward the downstream side. However, by employing the diameter-reducing portion 24 having the inner diameter reducing from the upstream side toward the downstream side as the introduction portion, as in the embodiment and the modification examples described above, it is possible to straighten the flow of the fluid guided from the outside of the compressor housing 6 to suppress the disturbance of the flow of the fluid.

Furthermore, in the embodiment described above, the intake-air flow passage 11*a* includes the tapered portion 11*b* provided at a position closer to the downstream side than the diameter-reducing portion 24 in the flowing direction of the main flow and having the inner diameter gradually decreased from the upstream side toward the downstream side. With this configuration, after the fluid flowing out from the other end 22*b* of the return flow passage 22 merges with the main flow, the main flow is also straightened with the tapered portion 11*b*. Thus, it is possible to further suppress the disturbance of the flow of the fluid.

Furthermore, in the embodiment and the modification examples described above, description has been made of the case where the diameter-reducing portion 24 is detachably formed in the compressor housing 6. However, the diameter-reducing portion 24 may be formed integrally with the compressor housing 6. Note that it may be possible to employ a configuration in which screw threads are formed around, for example, the outer peripheral surface 24*d* of the diameter-reducing portion 24, and screw grooves, which are to be screwed onto the screw threads on the diameter-reducing portion 24, are formed on the inner wall of the compressor housing 6 that forms the air intake space 11, whereby the diameter-reducing portion 24 is fixed to the compressor housing 6 through screw fastening.

Furthermore, in the embodiment and the modification examples described above, description has been made of the case where the ring-shaped passage 25 is formed. However, the ring-shaped passage 25 is not an essential configuration.

Furthermore, in the embodiment and the modification examples described above, description has been made of the case where the ring-shaped passage 25 extends toward the upstream end 24*a* side of the diameter-reducing portion 24 than the other end 22*b* of the return flow passage 22, and the cross sectional area of the ring-shaped passage 25 in the radial direction of the shaft 8 increases from the upstream end 24*a* side of the diameter-reducing portion 24 toward the downstream end 24*b* side. However, it may be possible to employ a configuration in which the ring-shaped passage 25 does not extend closer to the upstream end 24*a* side of the diameter-reducing portion 24 than the other end 22*b* of the return flow passage 22. Furthermore, it may be possible to employ a configuration in which the cross sectional area of the ring-shaped passage 25 in the radial direction of the shaft 8 does not increase from the upstream end 24*a* side of the diameter-reducing portion 24 toward the downstream end 24*b* side, and the cross sectional area of the ring-shaped passage 25 remains constant or decreases.

Furthermore, in the embodiment and the modification examples described above, description has been made of the case where at least a part of the other end 22*b* of the return flow passage 22 overlaps with the diameter-reducing portion

24 in the radial direction of the shaft 8. However, it may be possible to employ a configuration in which the other end 22*b* of the return flow passage 22 does not overlap with the diameter-reducing portion 24 in the radial direction of the shaft 8.

These are descriptions of the embodiment of the present disclosure while attached drawings are being referred to. However, it is obvious that this embodiment does not restrict the present invention. It is apparent that persons skilled in the art are able to reach various modification examples or correction examples within the scope described in claims. Naturally, it is construed that these modification examples or correction examples belong to the technical scope of the present invention.

What is claimed is:

1. A centrifugal compressor, comprising:

a compressor wheel fixed to an end portion of a rotating shaft;

a compressor housing configured to accommodate the compressor wheel;

a wall surface in the compressor housing, the wall surface forming an air intake space extending on an extension line of the rotating shaft and located on a front side of the compressor wheel;

a downstream-side flow passage provided radially outward of the rotating shaft, configured to guide fluid sucked from the air intake space and compressed by the compressor wheel, to the outside of the compressor housing;

a return flow passage provided with a first end and a second end, the first end opened to the downstream-side flow passage, and the second end opened to the wall surface of the compressor housing, the return flow passage configured to circulate the fluid guided by the downstream-side flow passage, from the downstream-side flow passage to the air intake space; and an introduction portion provided in the air intake space, including:

an outer peripheral surface brought into contact with the wall surface of the compressor housing on an upstream end side of the outer peripheral surface in a flowing direction of the fluid, and an inner peripheral surface forming a flow passage to guide fluid from the outside of the compressor housing into the air intake space, a downstream end of the inner peripheral surface in the flowing direction of the fluid being located radially inward of the wall surface of the compressor housing on which the second end of the return flow passage is opened; and a ring-shaped passage circularly extending in a rotational direction of the rotating shaft between the outer peripheral surface and the wall surface of the compressor housing, wherein the wall surface of the compressor housing includes a tapered portion extending downstream from the second end of the return flow passage, and at least part of the second end of the return flow passage overlaps with the introduction portion and the ring-shaped passage when viewed from a radial direction of the shaft.

2. The centrifugal compressor according to claim 1, wherein the introduction portion includes a diameter-reducing portion, and the diameter-reducing portion has an inner diameter reducing from an upstream side of the diameter-reducing portion toward a downstream side thereof in the flowing direction of the fluid.

3. The centrifugal compressor according to claim 1, wherein the ring-shaped passage includes a part extending toward an upstream end side of the introduction portion, the part being closer to the upstream end side of the introduction portion than the second end of the return flow passage, and a cross-sectional area of the ring-shaped passage in the radial direction of the rotating shaft increases in a direction from the upstream end side of the introduction portion toward a downstream end side thereof.

4. The centrifugal compressor according to claim 1, wherein the introduction portion is detachably provided into the compressor housing.

5. A turbocharger comprising a centrifugal compressor according to claim 1.

6. The centrifugal compressor according to claim 1, wherein the return flow passage has a width in a planar direction perpendicular to the rotating shaft, the width increasing toward the wall surface of the compressor housing.

7. The centrifugal compressor according to claim 1, wherein the tapered portion extends from the second end of the return flow passage to part of the wall surface around the compressor wheel.

* * * * *